United States Patent [19]

Gustafsson

[11] Patent Number: 4,645,892

[45] Date of Patent: Feb. 24, 1987

[54] SEALING ARRANGEMENT FOR MICROWAVE OVENS

[75] Inventor: Jan A. C. Gustafsson, Norrköping, Sweden

[73] Assignee: U.S. Philips Corporation, New York, N.Y.

[21] Appl. No.: 588,413

[22] Filed: Mar. 12, 1984

[30] Foreign Application Priority Data

Mar. 15, 1983 [SE] Sweden ..... 8301397

[51] Int. Cl.[4] ..... H05B 6/64

[52] U.S. Cl. ..... 219/10.55 D; 219/10.55 F

[58] Field of Search ..... 219/10.55 D, 10.55 F, 219/10.55 R; 174/35 GC, 35 R

[56] References Cited

U.S. PATENT DOCUMENTS 3,767,884 10/1973 Osepchuk et al. ..... 219/10.55 D
4,313,044 1/1982 Staats ..... 219/10.55 D
4,475,023 10/1984 Iwabuchi et al. ..... 219/10.55 D

FOREIGN PATENT DOCUMENTS 1368105 9/1974 United Kingdom .

*Primary Examiner*—E. A. Goldberg
*Assistant Examiner*—M. M. Lateef
*Attorney, Agent, or Firm*—Robert J. Kraus

[57] ABSTRACT

A sealing arrangement for microwave ovens, comprising an attenuation choke (20) extending around an access opening to an oven cavity and arranged either in the cavity wall portion surrounding the access opening or in the rim portions of a door (19) closing the opening. The choke (20) has a generally G-shaped profile, the horizontal inner leg of the G forming a partition wall (23) in the choke. The partition wall (23) on one side bounds an entrance opening (26) to the choke and on the other side is contiguous with a wall forming a short-circuiting wall (24) and at the same time bounds an outer portions of the gap between the door and the cavity walls. Either the partition wall (23), or the short-circuiting wall (24), or both, are provided with slots (25) extending transversely to the circumference of the door (19) or access opening.

13 Claims, 13 Drawing Figures

SEALING ARRANGEMENT FOR MICROWAVE OVENS

BACKGROUND OF THE INVENTION

The invention relates to a sealing arrangement for a microwave oven having an oven cavity with an access opening closable by a door. The sealing arrangement comprises an attenuation choke which extends around the access opening at least when the door is closed, and which is arranged either in wall portions of the cavity surrounding the access opening or in rim portions of the door. The choke has an input opening adjacent a gap leading from the oven cavity past the input opening to the space outside the cavity and also has a short-circuiting wall situated at a distance of approximately ½ wavelength at the operating frequency from the inner end of the gap at the cavity, and which is provided with transverse slots in a wall thereof.

Choke arrangements comprising slotted walls have previously been proposed as sealing devices in microwave ovens. Such slots in a choke wall prevent the generation of higher oscillation modes in the elongated attenuation chokes and will thereby decrease the quantity of leaking energy. A type of slotted choke for microwave ovens is for example described in U.S. Pat. No. 3,767,884. Here the slots are situated in a choke side wall, which at the same time forms a separation wall betwee the choke space and an input gap leading from the oven cavity to the input opening of the choke. Another type of choke having a slotted wall is described in United Kingdom Pat. No. 1,392,498. In this case the choke space is divided into two sub-spaces by a slotted partition wall. Both sub-spaces are open towards the gap formed between the cavity walls surrounding the access opening and the door, which gap forms a transmission path for the leakage energy. Each such sub-space serves as a choke and the arrangement can be regarded as two complete chokes arranged in sequence in the propagation path for the leakage energy. As it is the common partition wall for these two sub-spaces that is slotted, both these chokes comprise a slotted wall.

SUMMARY OF THE INVENTION

An object of the invention is to provide a sealing arrangement for microwave ovens which both conserves space and improves sealing against leaking energy as compared with known arrangements.

According to the invention this is achieved by means of an arrangement as set forth in the opening paragraph which is characterized in that the choke has a generally G-shaped profile, in that a partition wall corresponding to the inner horizontal leg of the G bounds, on one side thereof, the input opening to the choke and is contiguous, on the other side thereof, with a wall which both forms a short-circuiting wall and bounds a portion, remote from the oven cavity, of said gap, and in that slots extending transversally to the circumference of the door or the access opening are arranged in the partition wall and/or the short-circuiting wall.

In a choke construction embodying the invention, the choke thus consists of two sub-spaces which together form a U, and slots are arranged in a partition wall, which is common to the sub-spaces, and/or in the short-circuiting wall which also forms a wall bounding the outer portion of the gap. In spite of its smaller need of space such a construction has proved to give astonishingly good results. In particular, the magnitude of leaking energy has proved to be so small that the attenuation material which is commonly used in combination with the choke can be omitted.

With a rectangular access opening and door, the transversal slots may comprise corner slots arranged in the partition wall and/or the short-circuiting wall at the corners of the access opening or door. It has been proved that using only such corner slots will by itself bring about a substantial reduction of the magnitude of leaking energy. However, a further substantial reduction of the leakage can be achieved if slots are arranged with substantially constant pitch along the whole circumference of the door or access opening, respectively.

A very inexpensive choke construction is obtained if the profile is made integrally by folding of a conductive sheet. The corner slots then can be made by ensuring that the folded portions do not make mutual contact at the corners after folding, while slots which are distributed along the circumference may be punched in the sheet before folding.

If the choke is situated in the door, the whole door can be made integrally by folding of a pre-punched sheet. The whole manufacture of the door may then consist of two working operations, a punching operation and a folding operation. In the first step, the corner cuts necessary for the following folding operation are made together with the slots and the perforations or possibly a cut for the introduction of a perforated disc allowing inspection. Thereafter, the manufacture of the door is completed by the folding operation.

BRIEF DESCRIPTION OF THE DRAWING

Embodiments of the invention will now be described by way of example with reference to the accompanying drawing, in which.

DESCRIPTION OF THE PREFERRED EMBODIMENTS

Figure 1:
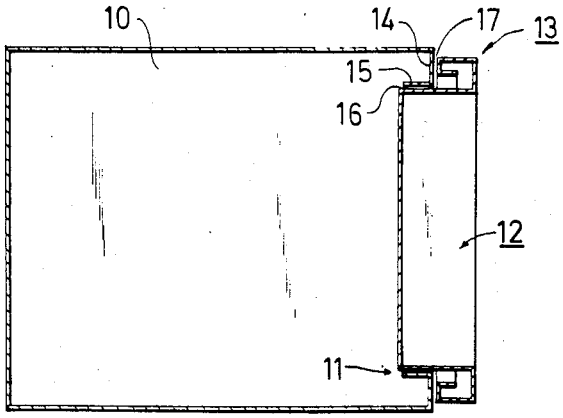
FIG. 1 is a schematic sectional view through an oven cavity with a door (shown closed), wherein a choke embodying the invention is situated in the door rim.

In FIG. 1 reference numeral 10 designates an oven cavity comprising an access opening 11 at its front. A door 12 closes the access opening. In its rim portion, the door 12 has an attenuation choke 13 which when the door is closed co-operates with the oven front for preventing escape of microwave energy. In the embodiment shown in FIG. 1, the oven front consists of two perpendicularly folded portions 14, 15 of the walls of the cavity surrounding the opening. When the door is closed, the door plane is situated somewhat inside the plane of the oven front, an inner portion 16 of the gap between the door and the walls of the cavity being formed between the folded portion 15 of the oven front and the opposed portion of the door rim. An outer portion 17 of the gap is formed between the front portion 14 and the opposed portion of the choke.

Figure 2A:
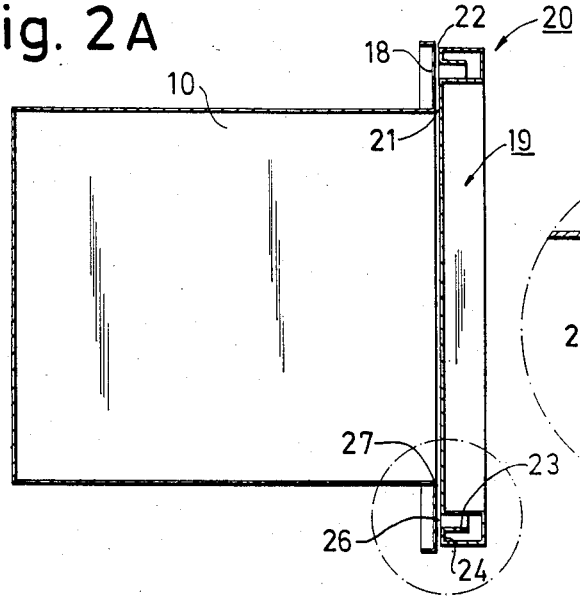
FIG. 2A is a schematic sectional view through an alternatively shaped oven front and door, with a choke embodying the invention again situated in the door rim.

In FIG. 2A the front 18 consists of folded portions of the walls of the cavity surrounding the access opening and the door 19 is situated with its plane aligned with the plane of the oven front. A choke 20 of the same basic shape as the choke 13 in FIG. 1 is formed in the rim of the door, a gap inner portion 21 being formed between the oven front and the opposed portion of the door. A gap outer portion 22 is as before formed between the oven front and the opposed choke portion.

An advantage of the embodiment of FIG. 1 is that the oven front is substantially half as wide as in the embodiment of FIG. 2A. On the other hand, the thickness of the door plus the choke will be somewhat larger than in FIG. 2A.

Figure 2B:
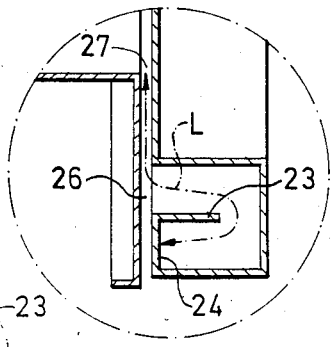
FIG. 2B is an enlarged view of the circled portion of FIG. 2A.
Figure 4:
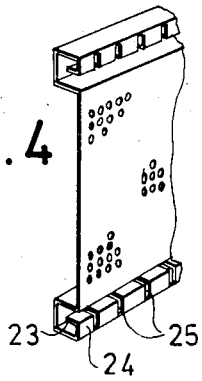
Figure 5:
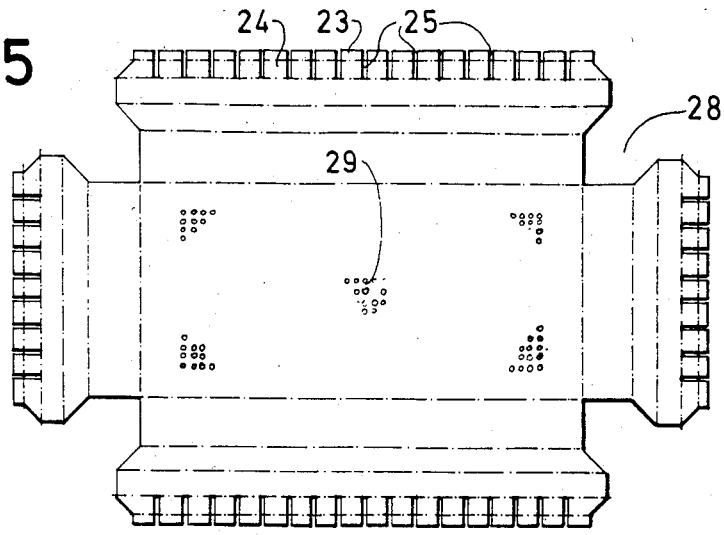
FIG. 5 shows the shape of a pre-punched sheet which after folding forms the door of FIGS. 3 and 4.

In both cases the choke embodying the invention has a generally G-shaped profile and is made by folding of a pre-punched sheet. This is shown in detail in FIGS. 3, 4 and 5 for the embodiment of FIG. 2A, FIGS. 3 and 4 being respectively a partly cut-away perspective view and a partial perspective view of the door as seen from the front and from behind, respectively, and FIG. 5 showing the punched sheet before it is folded to form a door. As is evident from FIGS. 4 and 5, two of the choke walls, more particularly the folded wall 23 corresponding to the horizontal inner leg in the G and the choke wall 24 connected thereto, which wall when the door is closed bounds the outer portion of the gap, are provided with transverse slots 25 evenly distributed around the circumference of the door. The former wall 23 forms a partition wall in the choke, while the latter wall 24 forms a short-circuiting wall. In FIGS. 2A and 2B, the input opening to the choke is designated 26 and the inner portion of the gap is designated 27. Thus it is the transmission path leading from the inner portion 27, via the input opening 26, and past the slotted partition wall 23, to the short-circuiting wall 24 which is ½ wavelength long. In FIG. 2B, this transmission path is designated L.

Figure 3:
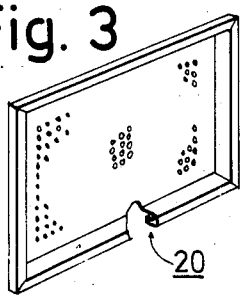
FIG. 3 and FIG. 4 are respectively a partly cut-away perspective view and a partial perspective view of the door of FIG. 2 seen from the front and from behind, respectively.

The manufacture of the door is very simple. One starts from a single sheet of metal and treats the same by a punching operation so that the shape shown in FIG. 5 is obtained. Besides the already-mentioned slots 25, corner cuts 28, necessary for the following folding operation, are punched in this operation. Furthermore perforations 29 for enabling inspection of the cavity can be punched in the central part of the door. When the punching is finished the folding is done in several steps so that the door shown in FIGS. 3 and 4 is obtained. Owing to the fact that the attenuation choke and perforated sheet are formed integrally, problems connected with the making of sealed joints are avoided while at the same time the material costs are minimized.

If the sheet thickness in the door is selected to be 0.5–1 mm, a rigid construction is obtained which facilitates application of decorative details and hinges; however, the visibility through the perforations will be relatively poor. In order to enable a "finer" perforation with better visibility, a sheet thickness of about 0.2 mm can be selected. However, the door front then must be completed with a rigid frame construction.

Figure 6:
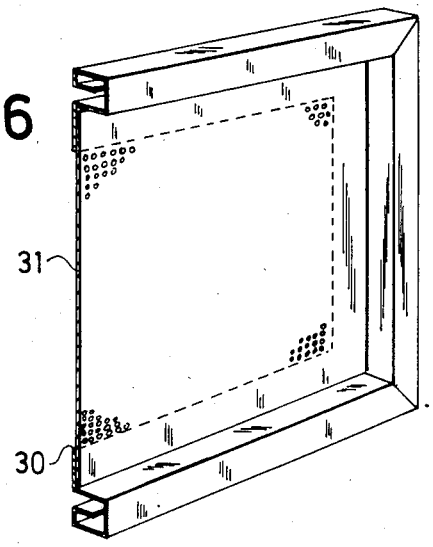
FIG. 6 is a partial perspective view of a door of the same basic construction as the door of FIGS. 3 and 4, but having a somewhat different detailed construction.

FIG. 6 shows a modification of the door shown in FIGS. 3 and 4. The modification consists therein that instead of perforations a rectangular window 30 is punched in the central part of the door. In this window a finely perforated metallic mask 31 is then fastened, for example by glueing. The shape of the choke and the manufacture of the door is otherwise the same as described in connection with FIGS. 3–5.

Figure 7:
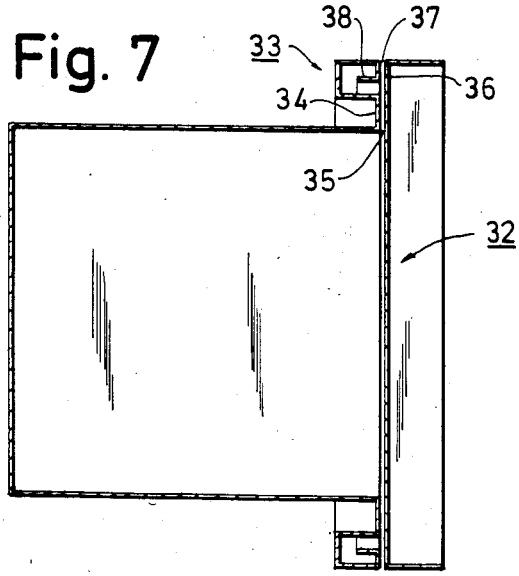
FIG. 7 is a schematic sectional view through a cavity with a door (shown closed), wherein a choke arrangement embodying the invention is situated in the oven front.

FIG. 7 is a schematic sectional view through a sealing arrangement embodying the invention having an alternative location of the attenuation choke. In this case the door 32 has a plane shape and seals against the oven front, where the choke 33 is situated. The front and the choke are integrated, with folded portions of the walls of the cavity surrounding the access opening. A first folded portion 34 forms, together with the closed door, gap inner portion 35. The choke is terminated by the short-circuiting wall 36, which at the same time bounds the gap outer portion 37, and the folded portion 38 forms a partition wall in the choke. These two walls, the short-circuiting wall 36 and the partition wall 38, are provided with transverse slots.

The manufacture is effected by folding and assembling of pre-punched sheet pieces, for example in the manner as described in the Swedish Patent Application No. 8207382-6.

FIGS. 8*a*–8*e* are perspective views of a corner of a door of the basic embodiment shown in FIG. 1 with different respective slot arrangements. These slot arrangements have been used in practical experiments for measuring the magnitude of the microwave leakage in a microwave oven provided with a sealing arrangement embodying the invention, and in particular the role of the slots in this leakage. The results of the measurements are shown in the following table.

| Test No. | Door of FIG. | Opening of the door: mm | Leakage: mW/cm$^2$ |
|---|---|---|---|
| 1 | 8a | 0 | 2.34 |
| 2 | 8b | 0 | 0.31 |
| 3 | 8c | 0 | 0.05 |
| 4 | 8c | 4 | 1.0 |
| 5 | 8d | 0 | 1.01 |
| 6 | 8e | 0 | 0.16 |

Figure 8A:
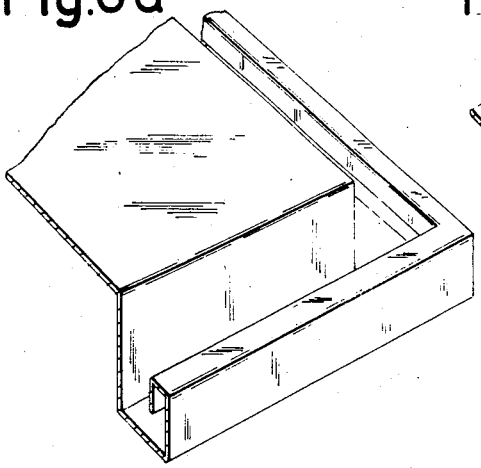
FIGS. 8*a*–8*e* are perspective partial views of different door chokes which have been used in practical experiments for determining the magnitude of the microwave leakage with different slot arrangements.
Figure 8B:
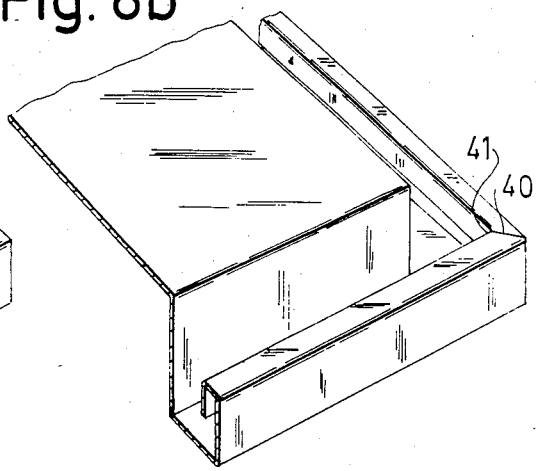
Figure 8C:
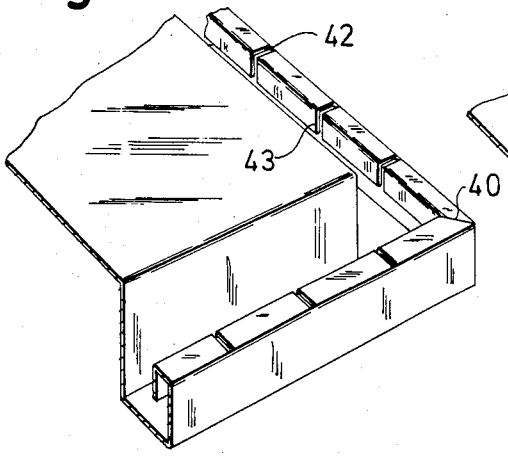
Figure 8D:
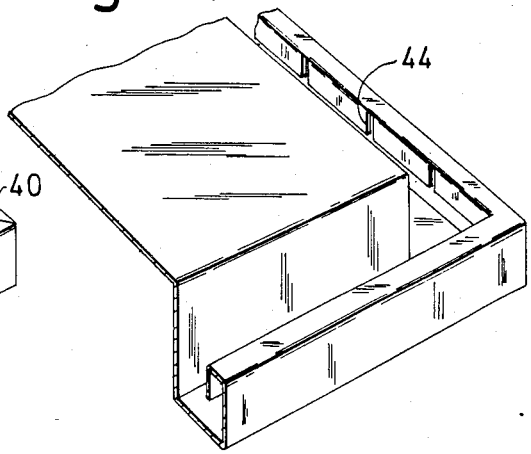
Figure 8E:
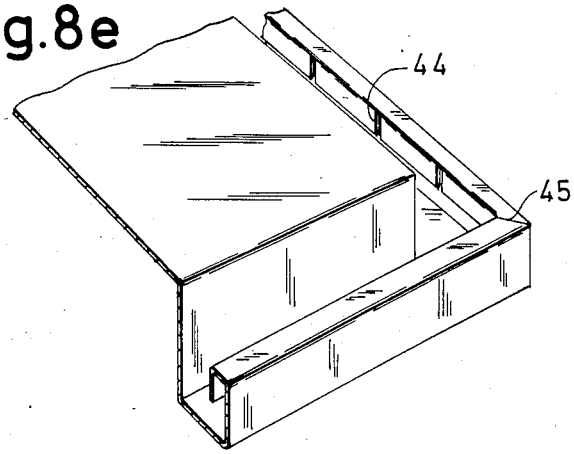

In test number 1, leakage measurement was made on a door, shown in FIG. 8*a*, having no slots and "closed" corners. The leakage was measured to be 2.34 mW/cm$^2$. In test number 2, measurements were made on a similar door but now having slots 40, 41 in the corners or "open" corners both of the portion folded into the choke and of the portion situated opposite the oven front (the short-circuiting wall): see FIG. 8*b*. These slots arise automatically during folding if the adjacent edges of the profile are not brought into contact with each other by the folding. The leakage was measured to be 0.31 mW/cm$^2$, i.e. a reduction by a factor of about 7.5 as compared with a "tight" profile. In test number 3 measurements were made on a door, which in addition to these corner slots was also provided with slots 42, 43 round the whole circumference of the door with a pitch of about 20 mm, see FIG. 8*c*. The leakage was now measured to be 0.05 mW/cm$^2$, i.e. a further reduction by a factor of 6 as compared with test number 2. In test number 4 measurements were made on the same door as in test number 3 but with the door opened by about 4 mm at the edge remote from the hinges. The leakage was now measured to be 1.0 mW/cm$^2$, i.e. still approximately half as much as prescribed by the authorities as the maximum leakage in the most unfavourable circumstances before safety switches interrupt the energy supply. In test number 5 measurements were made on a door having slots 44 round the whole circumference of the door, including the corners, but only in that part which is folded into the choke, i.e. in the partition wall, see FIG. 8*d*. The leakage was measured to be 1.01 mW/cm$^2$. Finally in test number 6 measurements were made on a similar door as in test number 5, but with slots 45 in the corners, or open corners, and also in the part situated opposite the front (the short-circuiting wall): see FIG. 8*e*. The leakage was now measured to be 0.16 mW/cm$^2$.

The above values show that even a few slots, for example only corner slots which can arise automatically in the folding, result in a large reduction of the microwave leakage, but that a further reduction can be obtained if additional slots are distributed along the whole circumference of the door.

What is claimed is:

1. A sealing arrangement for a microwave oven having an oven cavity with an access opening closable by a door, the sealing arrangement extending around the access opening when the door is closed, said sealing arrangement comprising a circumferential oven wall portion surrounding said access opening, a circumferential rim of the door cooperating with said circumferential oven wall portion to define a gap having an inner end communicating with the oven cavity, and a choke formed by said rim, said choke having an input opening communicating with the gap and having a short-circuiting wall situated at a distance of approximately ½ wavelength, at the operating frequency, from the inner end of said gap, and having a plurality of circumferentially-spaced transverse slots formed in a wall thereof, characterized in that the choke has a generally G-shaped profile, in that a partition wall forming the inner horizontal leg of the G bounds, on one side thereof, the input opening of the choke and is contiguous with a wall which both forms said short-circuiting wall and defines with the circumferential oven wall portion an outer end of said gap, and in that said transverse slots are formed in at least the partition wall.

2. A sealing arrangement as in claim 1 wherein the access opening and the door are rectangular, characterized in that the slots include corner slots arranged at the corners of the door.

3. A sealing arrangement as in claim 1 or 2, characterized in that the slots comprise slots distributed substantially evenly along the circumference of the door.

4. A sealing arrangement as in claim 1 or 2, characterized in that the G-shaped choke is integrally formed by a folded conductive sheet.

5. A sealing arrangement as in claim 2, characterized in that the G-shaped choke is integrally formed by a folded conductive sheet and in that the corner slots are formed by inwardly-folded portions of the conductive sheet which do not make mutual contact at the corners after the folding.

6. A sealing arrangement as in claim 4, characterized in that the slots are punched in the conductive sheet.

7. A sealing arrangement as in claim 4 where the entire door is integrally formed by a pre-punched, folded sheet having corner cuts necessary for the folding, and having the slots distributed along the circumference of the door.

8. A sealing arrangement for a microwave oven having an oven cavity with an access opening closable by a door, the sealing arrangement extending around the access opening when the door is closed, said sealing arrangement comprising a circumferential oven wall portion surrounding said access opening, a circumferential rim of the door cooperating with said circumferential oven wall portion to define a gap having an inner end communicating with the oven cavity, and a choke formed by said circumferential oven wall portion, said choke having an input opening communicating with the gap and having a short-circuiting wall situated at a distance of approximately ½ wavelength, at the operating frequency, from the inner end of said gap, and having a plurality of circumferentially-spaced transverse slots formed in a wall thereof, characterized in that the choke has a generally G-shaped profile, in that a partition wall forming the inner horizontal leg of the G bounds, on one side thereof, the input opening of the choke and is contiguous with a wall which both forms said short-circuiting wall and defines with the circumferential rim an outer end of said gap, and in that said transverse slots are formed in at least the partition wall.

9. A sealing arrangement as in claim 8 where the access opening and the door are rectangular, characterized in that the slots include corner slots arranged at the corners of the circumferential oven wall portion.

10. A sealing arrangement as in claim 8 or 9, characterized in that the slots comprise slots distributed substantially evenly along the circumference of the oven wall portion.

11. A sealing arrangement as in claim 8 or 9, characterized in that the G-shaped choke is integrally formed by a folded conductive sheet.

12. A sealing arrangement as in claim 9, characterized in that the G-shaped choke is integrally formed by a folded conductive sheet and in that the corner slots are formed by inwardly-folded portions of the conductive sheet which do not make mutual contact at the corners after the folding.

13. A sealing arrangement as in claim 11, characterized in that the slots are punched in the conductive sheet.

* * * * *